US006155226A

United States Patent [19]

Ozawa et al.

[11] Patent Number: 6,155,226

[45] Date of Patent: Dec. 5, 2000

[54] ENGINE

[75] Inventors: Hisashi Ozawa; Teruo Nakada, both of Fujisawa, Japan

[73] Assignee: Isuzu Motors Limited, Tokyo, Japan

[21] Appl. No.: 09/194,336

[22] PCT Filed: Mar. 27, 1998

[86] PCT No.: PCT/JP98/01406

§ 371 Date: Nov. 24, 1998

§ 102(e) Date: Nov. 24, 1998

[87] PCT Pub. No.: WO98/44253

PCT Pub. Date: Oct. 8, 1998

[30] Foreign Application Priority Data

Mar. 28, 1997 [JP] Japan ..... 9-077910
Mar. 28, 1997 [JP] Japan ..... 9-077911

[51] Int. Cl.[7] ..... F02F 7/00
[52] U.S. Cl. ..... 123/195 C
[58] Field of Search ..... 123/192.1, 195 R, 123/195 C

[56] References Cited

U.S. PATENT DOCUMENTS 4,159,828 7/1979 Ostling et al. .

FOREIGN PATENT DOCUMENTS 53-79150 7/1978 Japan ..... F16J 15/16
54-8232 1/1979 Japan ..... F01M 11/00
58-2353 1/1983 Japan .
58-27551 2/1983 Japan .
2-35945 3/1990 Japan ..... F02F 11/00
4-109453 9/1992 Japan ..... F02F 7/00
4-277399 10/1992 Japan ..... F16M 1/021
7-247861 9/1995 Japan ..... F02B 77/13

*Primary Examiner*—Henry C. Yuen
*Assistant Examiner*—Katrina B. Harris
*Attorney, Agent, or Firm*—McCormick, Paulding & Huber LLP

[57] ABSTRACT

The present invention is applicable to an engine having a cylinder block and an oil pan connected with each other and has an object of improving sealing of the engine and easiness in assembling and manufacturing. In the invention, an oil pan (14) is suspended from a cylinder block (1) via connecting members (cylinder covers (12)) in a vibration-insulating manner, a member having a projection (44) is provided on one of confronted face portions of the cylinder block and oil pan, and a member having a recess (46) is provided on the other confronted face portion. When these members engaged with each other, sealing is established. These members are also slidable so that dimensional errors are tolerated. Thus, assembling is facilitated. The object of the invention is also attained when an elastic member (144) and a mounting member (plate (142)) are in turn adhered onto the oil pan (114), and the mounting member is secured on the cylinder block by tightening members (bolts (146)).

8 Claims, 7 Drawing Sheets

ENGINE

TECHNICAL FIELD

The present invention relates to an engine including a cylinder block and an oil pan attached to the cylinder block.

BACKGROUND ART

Conventionally, an oil pan is suspended from an engine body by directly mounting it on the engine body with bolts or the i :t like. The oil pan must be mounted very firmly by the bolts if sealing to an oil (oiltightness) and strength needed to suspend the oil pan and oil are considered. In this case, however, vibrations of the engine body are transmitted to the oil pan and noises are more radiated downward.

In order to restrain the noise radiation, employed was a method of restraining vibration transmission to the oil pan by placing a rubber between the engine body and the oil pan. However, a bolting force (mounting force) cannot be weakened since oil sealing should be insured. Thus, it is not possible to completely prevent vibration transmission. Another approach is to suspend the oil pan from a cylinder block via connection members so that vibrations are not transmitted to the oil pan. Between the oil pan and the cylinder block, provided is a floating adapter for sealing. The floating adapter is constituted by sandwiching a film resilient (or elastic) member between two members with an adhesive (Japanese Utility Model Application, Laid-Open Publication No. 4-109453). Another conventional approach is disclosed in Japanese Patent Application, Laid-Open Publication No. 7-247861.

However, the conventional engine disclosed in Japanese Utility Model Application, Laid-Open Publication No. 4-109453 encounters difficulty when the film resilient member for the floating adapter is fabricated and when the engine is assembled.

Further, the engine of Japanese Utility Model Application, Laid-Open Publication No. 4-109453 requires the members to be secured on the cylinder block and the oil pan, and the connection members to be fixed on the oil pan. As a result, there are three fixing points and the assembling process becomes complicated. Moreover, there are two contact planes between the cylinder block and one of the members and between the oil pan and the other member so that seal elements such as gaskets should be interposed to insure the sealing therebetween. This makes the sealing troublesome.

An object of the present invention is to provide an engine which can insure satisfactory sealing between engine parts while making an engine assembling process easier.

DISCLOSURE OF INVENTION

An engine of the present invention is characterized in that a connecting member is provided for suspending an oil pan from a cylinder block in a vibration-insulating manner, a member having a projection is provided on one of confronted face portions of the cylinder block and oil pan in such a manner that it extends along the one of the confronted face portions, and a mating member having a recess is provided on the other confronted face portion in such a manner that it extends along the other confronted face portion and can be engaged with the projecting member allowing the projecting member to slide relative to the mating member.

According to this engine, sealing is insured by tight contact between the first member having a projection and the second member having a recess. Further, these members are slidable relative to each other so that some dimensional errors are tolerated. Thus, assembling and manufacturing of the engine are facilitated.

Preferably, at least one of the first member having a projection and the second member having a recess is made from an elastic material.

It is preferred that the first or second member is mounted on the cylinder block or oil pan via a plate.

The connecting member is preferably a cylinder cover which covers the cylinder block.

Another engine according to the present invention is characterized in that a cylinder cover is suspended from each of side walls of a cylinder block in a vibration-insulating manner, a vibration damping layer is formed in a gap between each cylinder cover and the associated side wall of the cylinder block, each cylinder cover projects downward from a lower end of the cylinder block, a flange of an oil pan is joined with the projecting portions of the cylinder covers via a first plate, a second plate is attached to a lower end face of the cylinder block, the first and second plates are spaced from each other in a height direction of the cylinder block, a third member having a projection is secured on one of confronted surfaces of the first and second plates, a fourth member having a recess is secured on the other confronted surface, and the third and fourth members are engaged with each other in a slidable manner.

It is preferred that at least one of the third member having a projection and the fourth member having a recess is made from an elastic material.

It is also preferred that the third member includes a sharp free end, a peripheral groove next to the sharp free end and a convex portion next to the peripheral groove.

An engine according to still another aspect of the present invention is characterized in that an elastic member is adhered onto an oil pan, a mounting member is adhered on the elastic member, a through cutout is formed in the oil pan to allow a tightening member to penetrate through the cutout without contacting the cutout, the tightening member is inserted in the cutout, the mounting member is fixed to a cylinder block by the tightening member, and the oil pan is suspended from the cylinder block by a connecting member in a vibration-insulating manner.

In this engine, the elastic member and mounting member are united to the oil pan beforehand by an adhesive and the mounting member is only fixed onto the cylinder block so that there is only one tightening point. This enables high quality of sealing. Further, these elements are united beforehand so that the engine assembling process is also facilitated.

Here, the connecting member is preferably a cylinder cover which covers the cylinder block.

In addition, the elastic member is preferably rectangular in cross section and planar in contour.

An engine according to yet another aspect of the present invention is characterized in that a cylinder cover is suspended from each side wall of a cylinder block in a vibration-insulating manner, a vibration absorption layer is formed in a gap between each cylinder cover and the associated side wall of the. cylinder block, the cylinder covers project downward from a lower end of the cylinder block, a bent of a flange of an oil pan is joined with the projecting portions of the cylinder covers, a lower end face of the cylinder block is spaced from an upper face of the flange of the oil pan, an elastic member is fixed on the upper face of the flange, a plate is fixed on an upper face of the elastic member, and the plate is joined to the lower end face of the cylinder block.

A through cutout is preferably formed in the flange of the oil pan to allow a tightening member, which is used to join the plate, to penetrate through the cutout without contacting the cutout.

The through cutout is preferably a through hole.

The elastic member is preferably rectangular in cross section and planar in contour.

BEST MODE FOR CARRYING OUT THE INVENTION

Now, embodiments of the present invention will be described in reference to the accompanying drawings.

Figure 2:
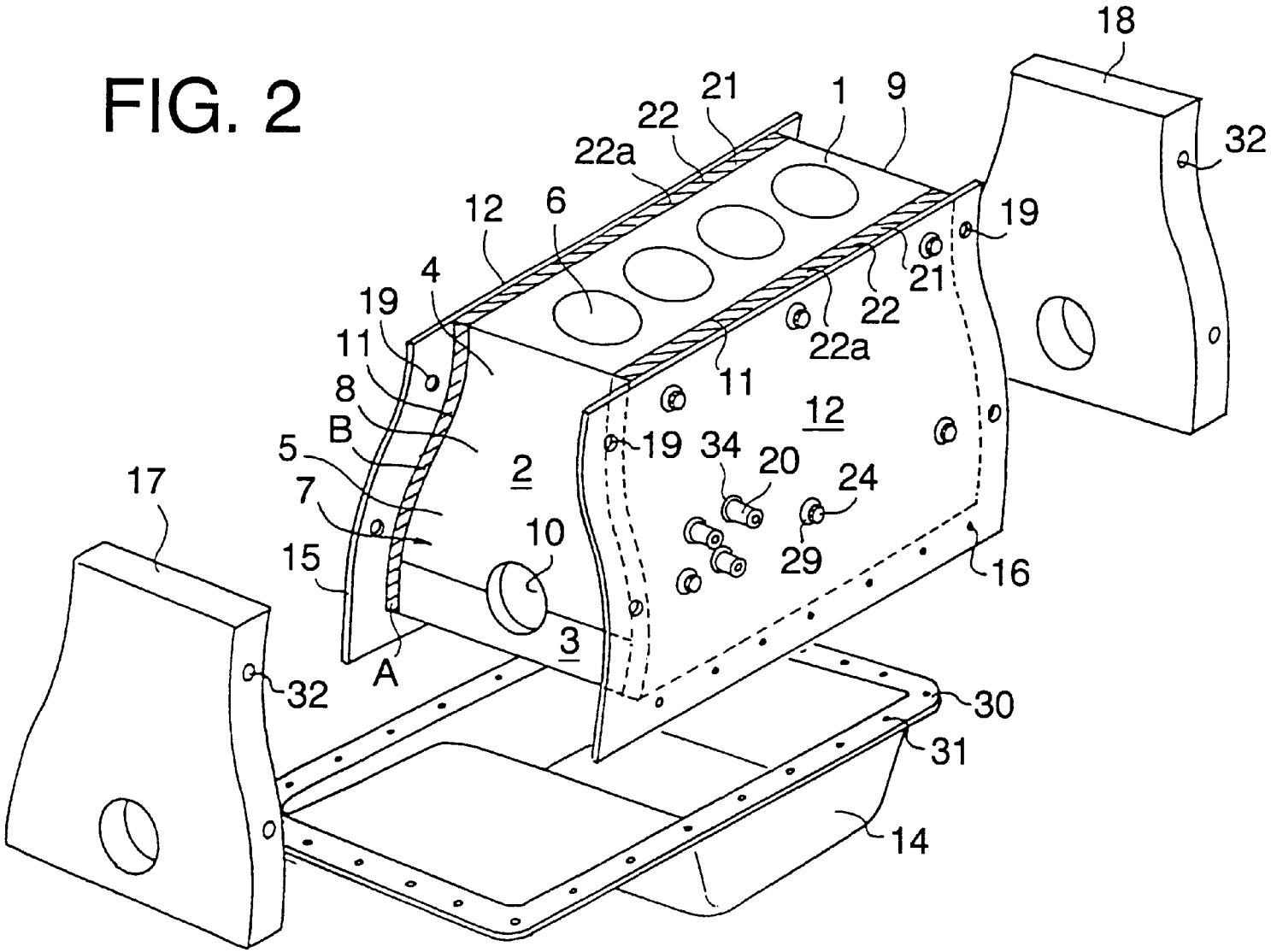
FIG. 2 is an exploded perspective view of the embodiment according to the present invention.

Referring to FIG. 2, illustrated is an engine according to one embodiment of the present invention. Reference numeral 1 designates a cylinder block which is divisible into upper and lower bodies in this particular embodiment. Reference numeral 2 designates the upper cylinder block and 3 the lower cylinder block. The upper cylinder block 2 has a cylinder portion 4 in its upper area and a skirt 5 in its lower area. The cylinder portion 4 has four bores 6 spaced at equal intervals in a longitudinal direction of the cylinder block. The lower cylinder block 3 which is open at its upper and lower surfaces is attached to the lower surface of the skirt 5. These parts define a crank chamber 7, inside which a crankshaft (not shown) extends. The cylinder block 1 having the above described structure has main bearings 10 for the crankshaft in end walls in the longitudinal direction thereof, i.e., the front wall 8 and rear wall 9.

Side walls 11 extending in parallel to the longitudinal direction of the cylinder block 1 have cylinder covers 12 covering the side walls entirely with a predetermined clearance.

Figure 3:
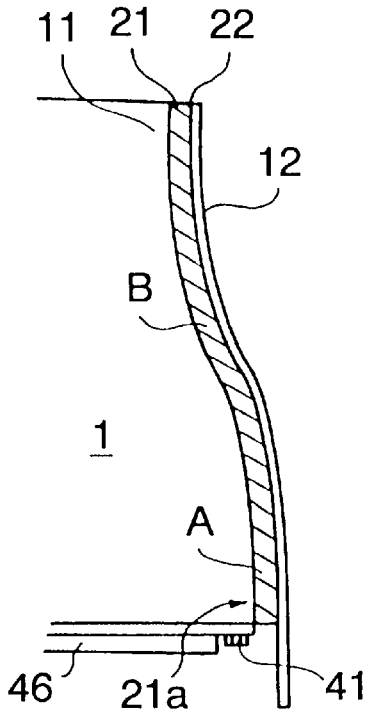
FIG. 3 illustrates a front view of the embodiment of the invention.

The cylinder covers 12 are fabricated from a steel plate or aluminum plate. As illustrated in FIG. 3, each of the cylinder covers 12 is shaped (or bent) to conform with the associated side wall 11 of the cylinder block. Each cylinder cover 12 also has six openings 13 for attachment to the cylinder block 1 (see FIG. 4). Along the lower edge of the cylinder cover 12, formed are a plurality of through holes 16 evenly spaced in the longitudinal direction of the cylinder block to allow insertion of bolts when an oil pan 14 is mounted. The height of the cylinder cover 12 is greater than that of the cylinder block 1 and the length (dimension in the longitudinal direction of the cylinder block) of the cylinder cover is larger than the cylinder block 1. Two openings 19 are formed along the front edge of each cylinder cover 12 to support a front cover 17 and similar two openings 19 are formed along the rear edge of each cylinder cover 12 to support a rear cover 18.

As illustrated in FIGS. 2 and 3, there is a predetermined gap 21 between the cylinder cover 12 and the associated side wall 11 of the cylinder block on each side of the cylinder block. This gap 21 is filled with a rubber-made vibration absorber having a foam structure which creates a vibration damping layer 22*a*. Specifically, the vibration damping layer 22*a* is comprised of a vibration absorbing plate 22. The vibration absorptive plate 22 has a rectangular shape and its height and length are equal to those of the associated side wall 11 of the cylinder block. The vibration absorptive plate 22 is mounted together with the associated cylinder cover 12 and clamped between the cylinder cover 12 and cylinder block side wall 11. The thickness of the vibration absorption plate 22 before being mounted is uniform and slightly larger than the gap 21. Thus, the vibration absorption plate 22 is compressed and deforms uniformly in its thickness direction upon mounting, so that it firmly contacts the mating surfaces of the cylinder cover and cylinder block side wall. Extensions 20 are integrally formed on the cylinder block side wall 11 for mounting of an auxiliary device. These extensions 20 penetrate openings formed in the vibration absorption plate 22 (not shown) and through holes 34 formed in the cylinder cover 12 and project outward.

Figure 4:
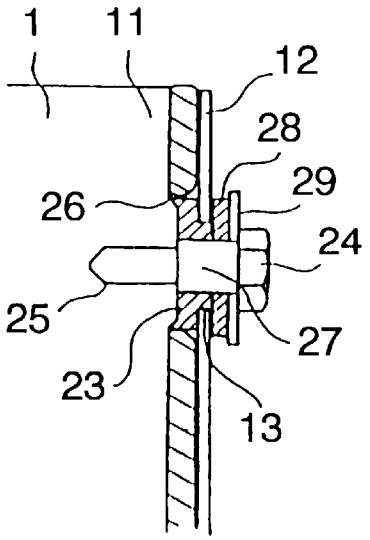
FIG. 4 illustrates an elevational cross section of a suspending structure for a cylinder cover in the embodiment of the invention.

As illustrated in FIG. 4, each cylinder cover 12 is supported on the cylinder block side wall 11 in a vibration-insulating manner. The cylinder block side wall 11 has attachment portions (small planar projections) 23 which serve as positional references for the holes 13 of the cylinder cover 12. Each of the attachment portions 23 has a bolt hole 25 for screwing of a shoulder bolt 24. The vibration absorption plate 22 has openings 26 at positions corresponding to the attachment portions 23. Each opening 26 has a diameter larger than the attachment portion 23. A divisible rubber member 28 having a groove is fitted over a shoulder portion 27 of each shoulder bolt 24. The periphery of each opening 13 of the cylinder cover 12 fits in the groove of the rubber member 28. Each rubber member 28 is secured on the associated attachment portion 23 via a washer 29 by the shoulder bolt 24.

Figure 6:
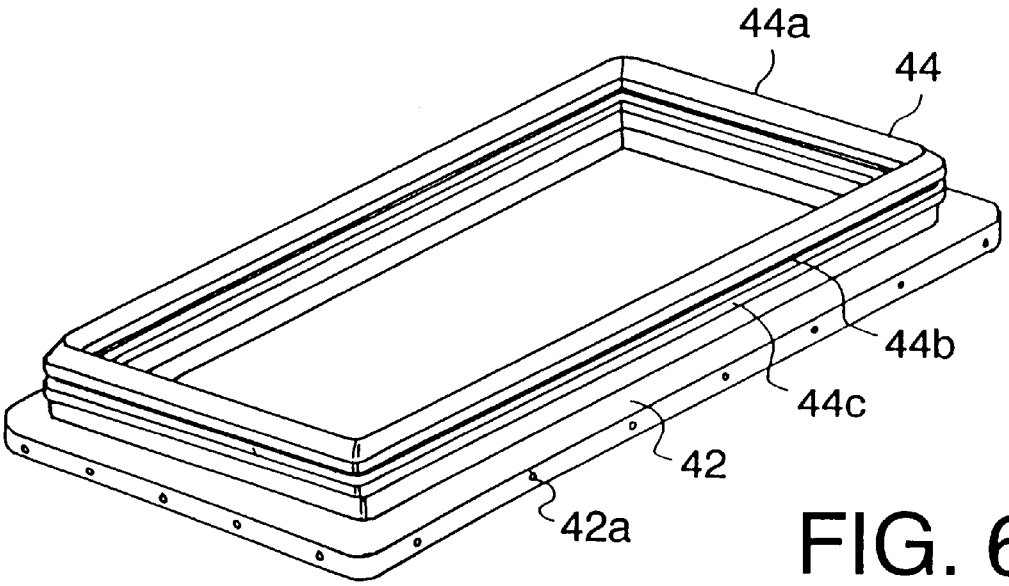
FIG. 6 illustrates a perspective view of another member having a projection and an associated plate according to the embodiment of the invention.
Figure 6A:
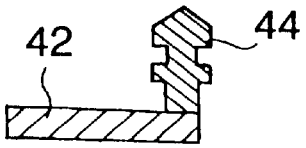
FIG. 6A illustrates a cross sectional view of the member having the projection and the associated plate shown in FIG. 6.

As illustrated in FIG. 2, the oil pan 14 has a flange 30 along its brim. A plurality of openings 31 are formed in the flange 30. As understood from FIGS. 1, 6 and 6A, a plate 42 having a shape similar to the flange 30 is placed on the upper surface of the flange 30. The plate 42 is united to the oil pan 14 by bolts 43. Specifically, the bolts 43 are inserted into the openings 31 and screwed into bores 42*b* formed in the plate 42 to join the plate 42 with the oil pan 14. Further, a projecting element 44 is fixed by a known method such as adhesion on the upper surface of the plate 42 along an inner periphery of the plate 42. The projecting member 44 has a sharp free end 44*a*, a groove 44*b* below the free end 44*a* and a protrusion 44*c* below the groove. The plate 42 has a plurality of screw holes 42*a* in its side face to mate the through holes 16 of the cylinder cover 12 respectively.

Figure 1:
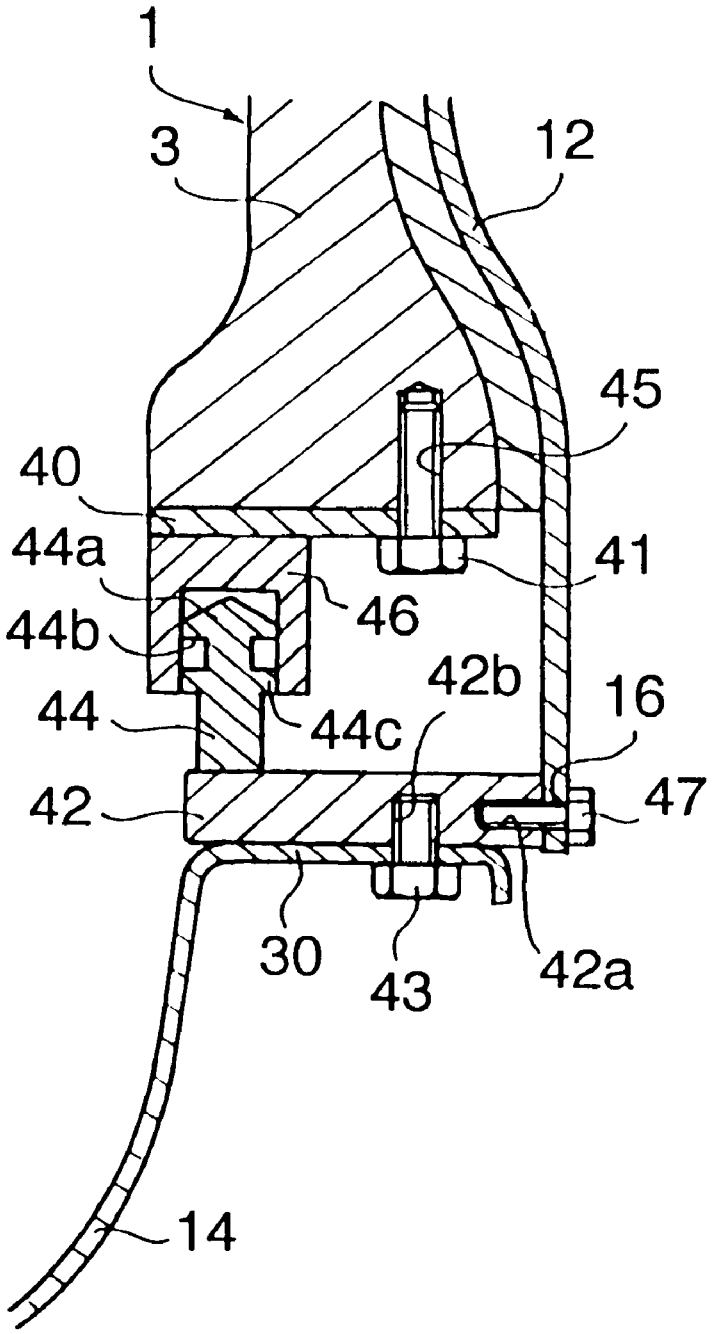
FIG. 1 illustrates a fragmentary elevational cross section of an engine according to one embodiment of the present invention.
Figure 5:
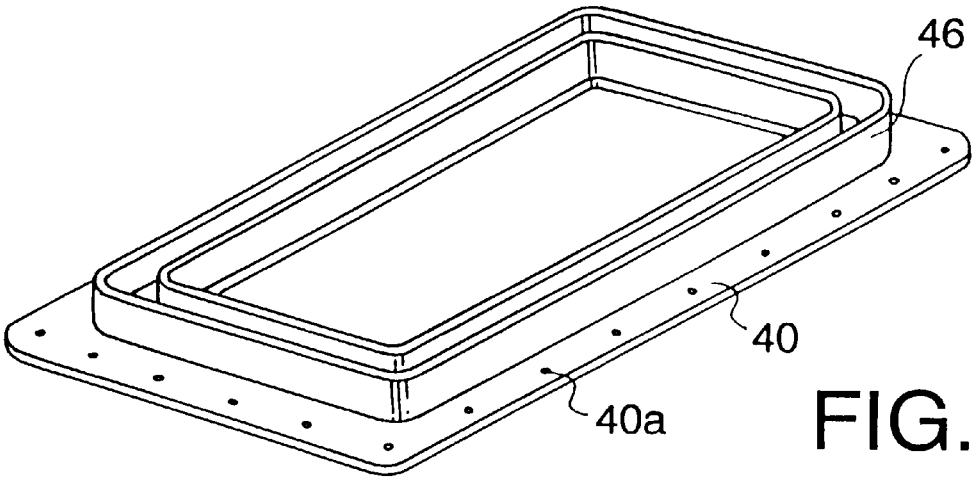
FIG. 5 is a perspective view illustrating a member having a recess and an associated plate in the embodiment of the invention.
Figure 5A:
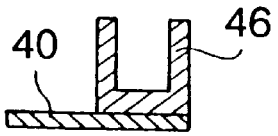
FIG. 5A illustrates a cross sectional view of the member having the recess and the plate in the embodiment of the invention.

As illustrated in FIGS. 1, 5 and 5A, on the other hand, another plate 40 is fixed to a lower end surface of the cylinder block 1 opposite the upper surface of the flange 30 of the oil pan 14 by bolts 41. The plate 40 has a shape similar to the lower end surface of the cylinder block 1. Specifically, the bolts 41 are inserted in openings 40*a* of the plate 40 and screwed into bores 45 to secure the plate 40 on the cylinder block 1 The plate 40 has a member 46 fixed on its lower surface along its inner periphery. The member 46 has a U-shaped cross section (or has a recess) and receives the projecting member 44 provided on the oil pan 14 in a slidable manner. The member having a recess 46 is open at its lower end (FIG. 1). At least one of the members 44 and 46 is made from a resilient or elastic material such as silicon rubber. In this case, at least the other is preferably made from a heat resisting resin or the like.

The oil pan 14 is suspended from the cylinder covers 12. Specifically, bolts 47 are inserted in the through holes 16 of the cylinder covers 12 and screwed into the holes 42*a* in the side face of the plate 42 to suspend the oil pan 14.

Now, a function of the engine according to this embodiment will be described.

Regarding vibrations and noises, direct transmission of vibrations to the cylinder covers 12 from the cylinder block 1 is restrained since the cylinder covers 12 are suspended in a vibration-insulating manner by the grooved rubber members 28. Further, indirect transmission of vibrations from the side walls 11 of the cylinder block in the form of airborne sound is significantly reduced since the airborne sound is absorbed by the vibration absorption plates 22. In particular, each of the vibration absorption plates 22 has a uniform foam structure so that its hardness is relatively low (soft) and it demonstrates good sound insulation. Further, the vibration absorption plates 22 cover the side walls 11 of the cylinder block completely so that they can absorb the sound very well. Moreover, vibrations of the cylinder covers 12 due to direct transmission of vibrations are also reduced by a damping effect of the vibration absorption plates 22. Therefore, it is possible to effectively and greatly reduce the vibrations of the cylinder covers 12 and reduce radiation of sound from the cylinder covers 12. Accordingly, the noises are significantly reduced.

As to sealing of the engine, adequate sealing is realized by tight contact between the projecting member 44 and the recessed member 46. In particular, if at least one of them is made from a resilient material, contact is enhanced and sealing is further improved.

The oil pan 14 is attached to the cylinder block 1 as follows; first, the plate 40 with the U-shaped member 46 secured thereon is fixed to the lower end of the cylinder block 1 by the bolts 41, and the plate 42 with the projecting member 44 adhered thereon is fixed to the flange 30 of the oil pan 14 by the bolts 43. Then, the cylinder block 1 and the oil pan 14 are moved toward each other in the height direction of the cylinder block so that the projecting member 44 is received in the recess of the mating member 46. The bolts 47 are inserted into the through holes 16 of the cylinder covers 12 and screwed into the holes 42*a* of the plate 42 to suspend the oil pan 14. Such easy procedure can join the oil pan 14 with the cylinder block 1. Thus, the assembling process becomes considerably easier.

In addition, since the bottom face of the projecting member 44 and that of the U-shaped member 46 are both flat, attaching these members onto the planar plates 40 and 42 are quite easy. Therefore, a manufacturing process is simplified and a manufacturing cost is reduced.

Further, the projecting member 44 and the mating U-shaped member 46 are slidable relative to each other in the height direction of the cylinder block so that even if there are some dimensional errors in, for example, the locations of the projecting member 44, U-shaped member 46 and through holes 16 of the cylinder covers 12, these elements can be assembled easily. In other words, strict dimensional accuracy is not required to the projecting member 44, U-shaped member 46 and relevant parts.

Moreover, even if the cylinder block 1 vibrates, vibrations are not directly transferred to the oil pan 14 since the projecting member 44 and the receiving member 46 are slidable.

It should be noted that although the cylinder covers 12 are used as connection members of the invention in the engine of this embodiment, elements separate from the cylinder covers and having an independent function such as stay-like parts may be used as the connection members of the invention.

Each of the vibration absorption plates 22 may have a higher density in its lower portion A than the remaining portion B. For instance, the lower portion A of the vibration absorption plate 22 may have a solid structure rather than a foam structure. This lower portion A is still able to seal the lower end of the gap 21.

Next, another embodiment of the present invention will be described in reference to the accompanying drawings.

Figure 9:
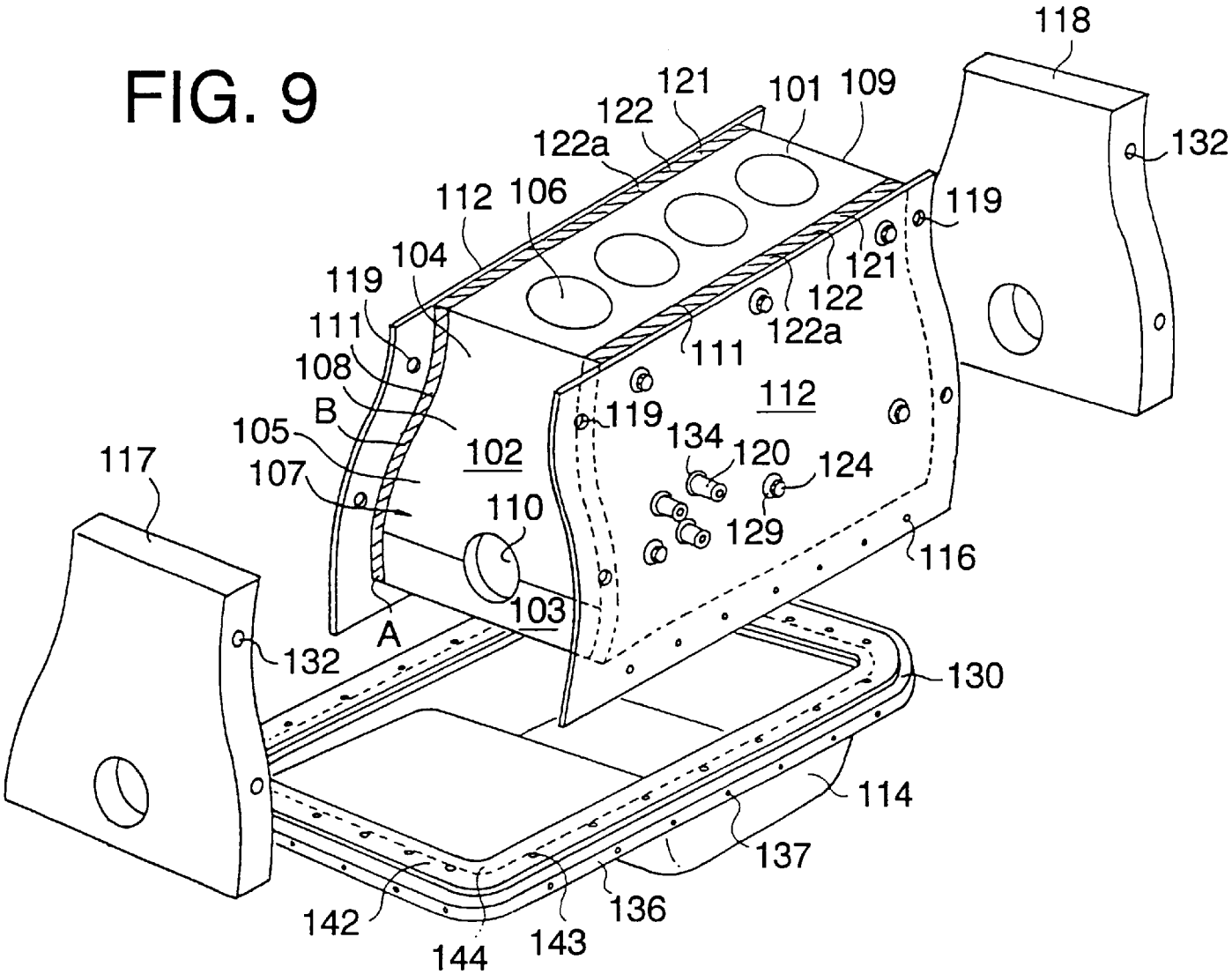
FIG. 9 is an exploded perspective view of the embodiment shown in FIG. 7.

Referring to FIG. 9, depicted is an engine according to the second embodiment. Reference numeral 101 denotes a cylinder block which is divisible in the height direction of the cylinder block in the illustrated embodiment. Reference numeral 102 denotes an upper cylinder block and 103 a lower cylinder block. The upper cylinder block 102 has a cylinder portion 104 in its upper area and a skirt 105 in its lower portion. Four bores 106 evenly spaced in the longitudinal direction of the cylinder block are formed in the cylinder portion 104. The lower cylinder block 103 which is open at its upper and lower faces is mounted to the bottom of the skirt 105. These elements define a crank chamber 107, in which a crankshaft (not shown) extends. The cylinder block 101 having the above described construction has main bearings 110 for the crankshaft in its end walls in the longitudinal direction, i.e., front wall 108 and rear wall 109.

Each of side walls 111 extending along the longitudinal direction of the cylinder block 101 has an associated cylinder cover 112 overlaying the side wall entirely with a predetermined gap.

Figure 10:
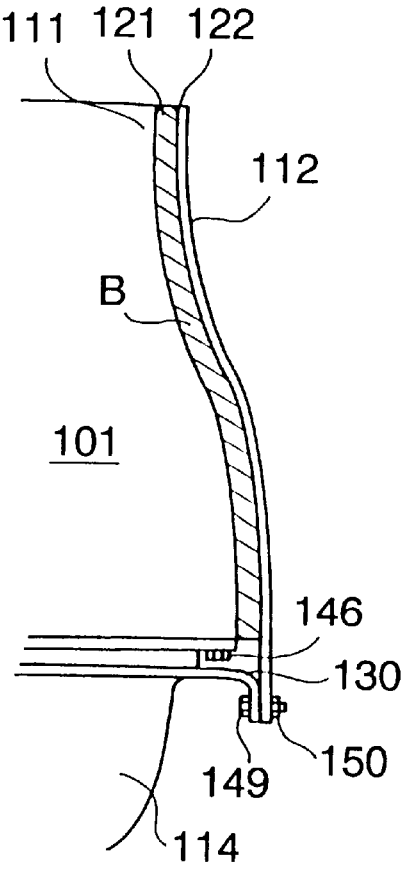
FIG. 10 illustrates a front view of the second embodiment shown in FIG. 7.

The cylinder covers 112 are made from a steel plate, an aluminum plate or the like. As illustrated in FIG. 10, each cylinder cover 112 is bent to conform with the configuration of the associated side wall 111. Each cylinder cover 112 also has six holes 113 (see FIG. 11) for attachment to the cylinder block 101. The cylinder cover 112 further has a plurality of through holes 116 evenly spaced in the longitudinal direction of the cylinder block along its lower edge. Bolts are inserted inn these through holes to support an oil pan 114. The height of the cylinder cover 112 is larger than the cylinder block 101 and the length in the longitudinal direction of the cylinder cover is greater than the cylinder block 101. Along the front and rear edges of each cylinder cover 112, formed are four holes 119 (two at front and two at rear) for mounting of front and rear covers 117 and 118. Each cover 117, 118 includes a plurality of holes 132.

As illustrated in FIGS. 9 and 10, there is a predetermined gap between each cylinder cover 112 and the associated side wall 111 of the cylinder block. This gap 121 is filled with a rubber-made vibration absorption member having a foam structure. A vibration damping layer 122A is thus created. The vibration damping layer is a vibration absorption plate 122 in the embodiment. The vibration absorption plate 122 has a rectangular shape with its height and length being equal to those of the associated side wall 111. The vibration absorption plates 122 are attached together with the associated cylinder covers 112 and held between the associated side walls 111 and cylinder covers 112 respectively. The thickness of the vibration absorption plate 122 before being mounted is uniform and slightly larger than the gap 121. Accordingly, the vibration absorption plate 122 after mounted is compressed uniformly in its thickness direction so that it firmly contacts the mating surfaces of the side wall and cylinder cover respectively. It should be noted that the cylinder block side wall 111 has extensions 120 integrally to support an auxiliary part. These extensions 120 penetrate holes of the vibration absorption plate 122 (not shown) and holes 134 of the cylinder cover 112 and project outward.

Figure 11:
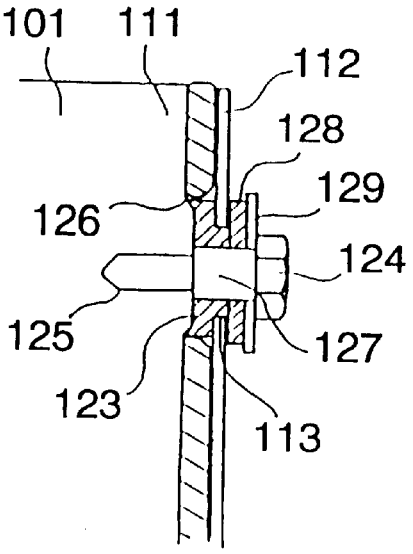
FIG. 11 is an elevational cross section of a suspending structure for a cylinder cover in the second embodiment.

As shown in FIG. 11, each cylinder cover 112 is supporter from the associated side wall 111 in a vibration-insulating manner. Each side wall 111 has attachment portions (small flat projections) 123 which serve as positional references for the holes 113 of the associated cylinder cover 112. Each attachment portion 123 has a screw hole 125 and a shoulder bolt 124 is screwed therein. Holes 126 greater than the attachment portions 123 in diameter are formed in each vibration absorption plate 122 at positions corresponding to the attachment portions 123. A rubber-made divisible member 128 fits over a stem 127 of each shoulder bolt 124. The rubber member 128 has a groove in which the periphery of the hole 113 of the cylinder cover 112 fits. The rubber member 128 is secured on the associated attachment portion 123 by the shoulder bolt 124 via a washer 129.

Figure 7:
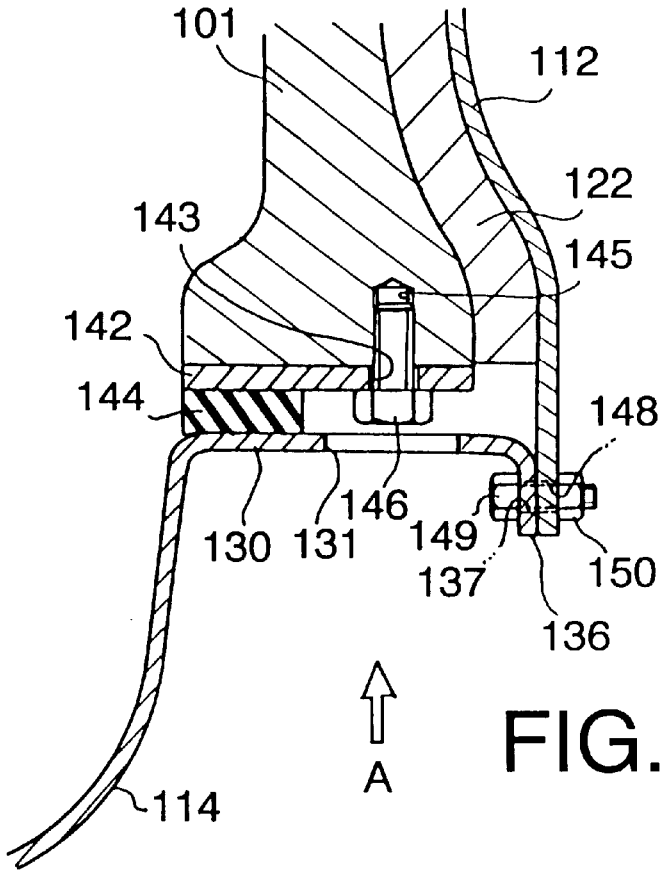
FIG. 7 is a fragmentary cross sectional view of an engine according to another embodiment of the present invention.
Figure 8:
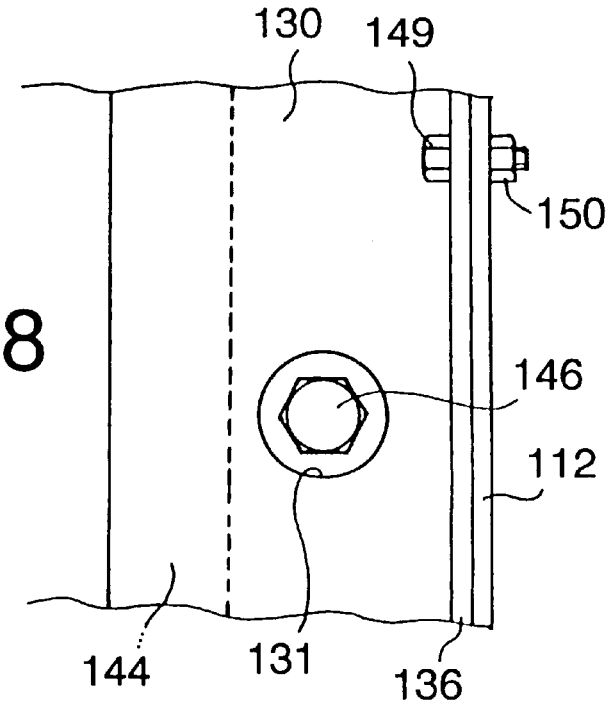
FIG. 8 is an illustration as viewed from the arrow A of FIG. 7.

As illustrated in FIG. 9, a flange 130 is formed along the brim of the oil pan 114. The flange 130 is further curved along the oil pan brim to create a bent 136. As shown in FIG. 7, the flange 130 has a plurality of through holes 131 (through notches of the invention) evenly spaced along the periphery thereof. As will be described, each of the through holes 131 has a size to allow insertion of a tool such as a head of a nut runner used to screw a bolt. The bent 136 has a plurality of through holes 137 at predetermined intervals along the length thereof. The flange 130 has a plate-like resilient member 144 adhered thereon, extending along its inner periphery. The elastic member 144 has a rectangular cross section. On the upper surface of the elastic member 144, adhered is a plate 142 (mounting member of the invention). The elastic member 144 is made from a material such as silicon rubber. The plate 142 has a plurality of through holes 143 at positions corresponding to the through holes 131 along the periphery thereof at predetermined intervals. In this manner, the elastic member 144 and plate 142 are adhered on the oil pan 114 beforehand so that these elements are function as a single unit.

A plurality of screw holes 145 are formed in the lower end face of the cylinder block 101 opposite the upper face of the flange 130 of the oil pan 114. These screw holes 145 are formed in the same manner as the through holes 131 and 143. The oil pan 114 is located below the cylinder block 101 in such a manner that the through holes 143 and 131 mate the screw holes 145. Then, bolts (tightening members of the invention) 146 are inserted from the through holes 131 and screwed into the holes 145 to join the oil pan 114 with the cylinder block 101. Although a clearance remains between the lower end face of the cylinder block 101 and the flange 130 of the oil pan 114, it is sealed by the elastic member 144 and the plate 142.

The cylinder cover 112 has through holes 148 along its lower edge in such a manner that these holes mate the through holes 137 of the bent 136. By inserting bolts 149 into these through holes 137 and 148 and tightening them with nuts 150, the oil pan 114 is suspended from the cylinder block 101 in a vibration-insulating manner.

Next, a function of the engine according to this embodiment will be described.

Regarding vibrations and noises, direct transmission of vibrations to the cylinder covers 112 from the cylinder block 101 is restrained since the cylinder covers 112 are suspended in a vibration-insulating manner by the associated grooved rubber members 128. Indirect transmission of vibrations from the cylinder block side walls 111 in the form of airborne sound is greatly reduced since the airborne sounds are absorbed by the vibration damping plates 122. In particular, a major portion B of each vibration damping plate 122 has a foam structure of low density, is relatively soft and highly sound proof. Further, the vibration absorption plates 122 completely cover the associated side walls 111 of the cylinder block so that their capability of absorption is very high. Vibrations of the cylinder covers 112 themselves due to direct transmission of vibrations are also reduced by a damping effect of the vibration absorption plates 122. Therefore, it is possible to effectively and greatly reduce the vibrations of the cylinder covers 112, restrain sound radiation from the cylinder covers 112 and significantly decrease the noises.

Since the oil pan 114 is attached to the cylinder covers, transmission of vibrations to the oil pan 114 from the cylinder covers 101 is considerably suppressed and radiation of noises from the oil pan 114 is controlled.

In addition, since the oil pan 114 is connected to the cylinder block 101 via the elastic member 144 so that it is not united firmly, vibrations of the cylinder block 101 are not directly transferred to the oil pan 114. From this point of view, radiation of noises from the oil pan 114 is also reduced.

Regarding the assembling of the engine, since the elastic member 144 and plate 142 are united to the oil pan 114 by an adhesive beforehand, handling during the assembling process is easy and productivity is improved. Further, since the cylinder block 101 and oil pan 114 are joined, there are only two connecting points; one is bolting of the plate 142 and the other is bolting of the cylinder covers 112 to the oil pan 114. As compared with a conventional structure which requires bolting at three points, a work for bolting is simplified and productivity is raised. Moreover, since the plate 142 attached to the oil pan 114 is secured onto the cylinder block 101 by inserting the bolts 146 from the through holes 131 and screwing them into the holes 143, the assembling becomes easier.

Because the elastic member 144 is planar, and the flange 130 of the oil pan 144 and the plate 142 are also both planar, it is very easy to join them by an adhesive. Thus, the manufacturing process is simplified and the manufacturing cost is reduced. Furthermore, the height of the elastic member 144 and plate 142 is small so that an engine height is not enlarged.

Regarding the sealing of the engine, bolting between the cylinder block 101 and the plate 142 is only needed, and the elastic member 144, plate 142 and oil pan 114 are united by an adhesive beforehand so that higher quality of sealing is insured when compared with the prior art which requires bolting at two locations.

Besides the foregoing, the cylinder block 101 does not require considerable changes in the design so that a cylinder block for a conventional engine is usable in the invention.

It should be noted that although the cylinder covers 112 are used as connecting elements of the invention in the above embodiment, elements separate from the cylinder covers and having an independent function such as stay-like elements may be used.

In this embodiment, the bent 136 of the oil pan 114 and the cylinder covers 112 are directly joined by the bolts 149 and nuts 150, but elastic elements may be interposed between the bent 136 and the cylinder covers 112. By doing so, the vibration absorption is further enhanced. When the stay-like parts are employed as the connecting members, they may firmly be mounted onto the cylinder block and joined with the oil pan via elastic members.

In the second embodiment, the plate 142 directly contacts the lower end face of the cylinder block 101 and is secured thereon by the bolts 146, but a suitable sealing means (e.g., rubber or liquid seal) may be placed between the lower end face of the cylinder block 101 and the plate 142. This will improve the sealing between the parts concerned and therefore the sealing of the engine of this embodiment as a whole.

In the illustrated embodiment, the through holes 131 are used as through cutouts, but V- or U-shaped notches may be satisfactory as long as the tightening members can penetrate without contacting the notches.

In this embodiment, the plate 142 is a single continuous plate, but a plurality of smaller plate segments may be arranged in a rectangular shape according to the shape of the lower end face of the cylinder block 101 and the flange 130 of the oil pan 114.

The vibration absorption plate 122 may have a higher density in its lower end area A than the other area B. For instance, the lower area A of the vibration absorption plate 122 may have a solid structure rather than the foam structure. In this case, the lower area A seals the lower end of the associated gap 121.

INDUSTRIAL APPLICABILITY

The present invention is applicable to the engine having a cylinder block and an oil pan connected to each other.

What is claimed is:

1. An engine comprising:

a cylinder block;

an oil pan;

an elastic member adhered onto the oil pan;

a mounting member adhered on the elastic member;

a tightening member;

a through cutout formed in the oil pan to allow the tightening member to penetrate through the cutout without contacting the cutout, the tightening member being inserted in the cutout when the mounting member is fixed to a cylinder block by the tightening member; and a connecting structure for suspending the oil pan from the cylinder block in a vibration insulating manner, the connecting structure including a cylinder cover placed over the cylinder block, and the oil pan being suspended from the cylinder block via the cylinder cover.

2. The engine as defined in claim 1, wherein the elastic member is rectangular in cross section and planar in contour.

3. An engine comprising:

a cylinder block having two side walls and a lower end;

cylinder covers for covering the side walls of the cylinder block respectively in such a manner that the cylinder covers project downward from the lower end of the cylinder block;

means for suspending each of the cylinder covers from each side wall of the cylinder block in a vibration-insulating manner with a gap;

a vibration absorption layer provided in the gap between each cylinder cover and the associated side wall of the cylinder block;

an oil pan having a flange along its brim and a bent along an outer periphery of the flange, the bent being joined with the projecting portions of the cylinder covers, a lower end face of the cylinder block being spaced from an upper face of the flange of the oil pan;

an elastic member secured on the upper face of the flange; and a plate secured on an upper face of the elastic member and joined to the lower end face of the cylinder block.

4. The engine as defined in claim 3 further including a through cutout formed in the flange of the oil pan for allowing a tightening member, which is used to join the plate, to penetrate through the cutout without contact the cutout.

5. The engine as defined in claim 4, wherein the through cutout is a through hole.

6. The engine as defined in claim 3, wherein the elastic member is rectangular in cross section and planar in contour.

7. The engine as defined in claim 4, wherein the elastic member is rectangular in cross section and planar in contour.

8. The engine as defined in claim 5, wherein the elastic member is rectangular in cross section and planar in contour.

* * * * *